US010215397B2

(12) United States Patent
Nawaz

(10) Patent No.: US 10,215,397 B2
(45) Date of Patent: Feb. 26, 2019

(54) FLASHLIGHT STUN GUN DEVICE

(71) Applicant: JAGUAR IMPORTS, LLC, Orlando, FL (US)

(72) Inventor: Babar Nawaz, Orlando, FL (US)

(73) Assignee: JAGUAR IMPORTS, LLC, Orlando, FL (US)

( * ) Notice: Subject to any disclaimer, the term of this patent is extended or adjusted under 35 U.S.C. 154(b) by 0 days.

(21) Appl. No.: 15/587,562

(22) Filed: May 5, 2017

(65) Prior Publication Data

US 2018/0320888 A1 Nov. 8, 2018

(51) Int. Cl.

| | |
|---|---|
| ***F21V 33/00*** | (2006.01) |
| ***F21L 4/00*** | (2006.01) |
| ***F41H 13/00*** | (2006.01) |

(52) U.S. Cl.

CPC ..... *F21V 33/0064* (2013.01); *F21L 4/005* (2013.01); *F41H 13/0018* (2013.01)

(58) Field of Classification Search

CPC ... F21V 33/0064; F41H 13/0018; F21L 4/005
See application file for complete search history.

(56) References Cited

U.S. PATENT DOCUMENTS 5,379,179 A * 1/1995 Graves ..... F41B 15/00 2/158
5,467,247 A * 11/1995 de Anda ..... F41H 13/0018 361/232
5,578,992 A * 11/1996 Harding ..... G08B 15/004 340/321
6,439,432 B1 * 8/2002 Park ..... F41H 9/10 222/113
6,643,114 B2 11/2003 Stethem
6,791,816 B2 9/2004 Stethem
7,524,076 B2 * 4/2009 Kukuk ..... F41C 23/10 362/109
D747,521 S * 1/2016 Sheikh ..... F21L 4/00 D22/117
D748,309 S * 1/2016 Cheng ..... F21L 2/00 D22/117
D788,959 S * 6/2017 Sheikh ..... F21V 33/00 D26/38
2002/0108966 A1 * 8/2002 Park ..... F41H 9/10 222/113

(Continued)

*Primary Examiner* — Donald L Raleigh

(74) *Attorney, Agent, or Firm* — Matthew G. McKinney, Esq.; Allen, Dyer et al.

(57) ABSTRACT

A flashlight stun gun device includes a cylindrical housing having a power source coupled to discharge circuitry, where the discharge circuitry has a first lead and a second lead. In addition, a light emitting source is secured to a top end of the cylindrical housing and is coupled to the power source. A collar is secured to the top end of the housing and around the light emitting source. First and second electrodes are embedded in a first portion of a top edge of the collar and have a first gap therebetween to generate an electric arc across. Third and fourth electrodes are embedded in a second portion of the top edge of the collar opposing the first pair of electrodes and have a second gap therebetween to generate an electric arc across. The electrodes are electrically coupled together in series when the discharge circuitry is activated.

18 Claims, 2 Drawing Sheets

(56) References Cited

U.S. PATENT DOCUMENTS

| | | | | |
|---|---|---|---|---|
| 2002/0162852 | A1* | 11/2002 | Cellini | F41B 15/02 222/1 |
| 2003/0165042 | A1* | 9/2003 | Stethem | F21V 33/0076 361/232 |
| 2006/0227534 | A1 | 10/2006 | Chang et al. | |
| 2007/0238532 | A1* | 10/2007 | Stethem | F41B 15/04 463/47.2 |
| 2009/0199884 | A1* | 8/2009 | Lessing | A45B 3/00 135/66 |
| 2009/0201621 | A1 | 8/2009 | Abatemarco | |
| 2010/0319740 | A1* | 12/2010 | Willey | A45B 1/04 135/66 |
| 2012/0140450 | A1* | 6/2012 | Motyka | A45B 3/00 362/102 |
| 2015/0267882 | A1* | 9/2015 | O'Brien | F21L 4/08 362/183 |
| 2016/0010956 | A1* | 1/2016 | Hanchett | F41H 13/0031 361/232 |
| 2016/0040965 | A1* | 2/2016 | Chang | F41H 13/0025 42/1.08 |
| 2016/0265868 | A1* | 9/2016 | Forsythe | F41B 9/009 |
| 2017/0241753 | A1* | 8/2017 | Nerheim | F41H 13/0025 |

* cited by examiner

FLASHLIGHT STUN GUN DEVICE

TECHNICAL FIELD

The present invention relates to the field of stun guns, and, more particularly, to flashlight stun gun devices.

BACKGROUND

Stun guns use a high voltage and a low current electrical discharge to immobilize an assailant. The electrical discharge causes the assailant's muscles to uncontrollably spasm so that the assailant is temporarily paralyzed. The voltage of a stun gun typically ranges between 20,000 to 650,000 volts. Batteries serve as a power supply to electrical circuitry consisting of various electrical components. The circuitry includes a transformer that boosts the voltage in the circuit and reduces the amperage of the electrical current. A capacitor is used to build up and store an electrical charge before discharging the electrical shock through a pair of electrodes to the assailant.

A shortcoming of the prior art stun guns is that they are often single purpose devices. Accordingly, a flashlight is carried separately with the stun gun making it cumbersome to both operate a stun gun and the flashlight. There have been attempts to combine a flashlight with a stun gun, but these stun guns are not sufficient to deter and immobilize potential assailants because of the placement of the electrodes proximate to the light. The light is placed in the middle of the stun gun with the electrodes on either side. The light must be relatively small so that the gap between the electrodes is small enough to arc across. The orientation of the electrodes are also insufficient to deter a potential assailant. Accordingly, what is needed is a flashlight stun gun that appears to be a regular sized flashlight and also has sufficient power to deter or immobilize potential assailants.

It is, therefore, to the effective resolution of the aforementioned problems and shortcomings of the prior art that the present invention is directed.

However, in view of the prior art at the time the present invention was made, it was not obvious to those of ordinary skill in the pertinent art how the identified needs could be fulfilled.

SUMMARY

A flashlight stun gun device is disclosed. The flashlight stun gun includes a cylindrical housing having a top end and a bottom end. A power source within the cylindrical housing is coupled to discharge circuitry within the housing, where the discharge circuitry has a first lead and a second lead. A light emitting source is secured to the top end of the cylindrical housing and is coupled to the power source. A collar is secured to the top end and around the light emitting source and has sidewalls extending away from the top end of the cylindrical housing and light emitting source to define a top edge of the collar.

First and second electrodes are embedded in a first portion of the top edge of the collar and have a first gap therebetween to generate an electric arc across, and third and fourth electrodes are embedded in a second portion of the top edge of the collar opposing the first pair of electrodes and having a second gap therebetween to generate an electric arc across. The first electrode is coupled to the first lead of the discharge circuitry, the second electrode is coupled to the third electrode, and the fourth electrode is coupled to the second lead and is insulated from the first electrode.

In addition, the flashlight stun gun includes a trigger coupled to the discharge circuitry and operable by a user to cause the electric arcs across the first and second gaps. The first, second, third, and fourth electrodes are electrically coupled together in series when the discharge circuitry is activated.

It is therefore an object of the present invention to provide for an improvement that overcomes the aforementioned inadequacies of the prior art and provides a significant contribution to the advancement of stun gun devices.

These and other important objects, advantages, and features of the invention will become clear as this description proceeds. The invention accordingly comprises the features of construction, combination of elements, and arrangement of parts that will be exemplified in the description set forth hereinafter.

Both the foregoing general description and the following detailed description are explanatory and are not restrictive of the invention. The accompanying drawings, which are incorporated in and constitute part of the specification, illustrate embodiments of the present invention and together with the general description, serve to explain principles of the present invention.

DETAILED DESCRIPTION

The present invention will now be described more fully hereinafter with reference to the accompanying drawings, in which preferred embodiments of the invention are shown. Like numbers refer to like elements throughout.

Figure 1:
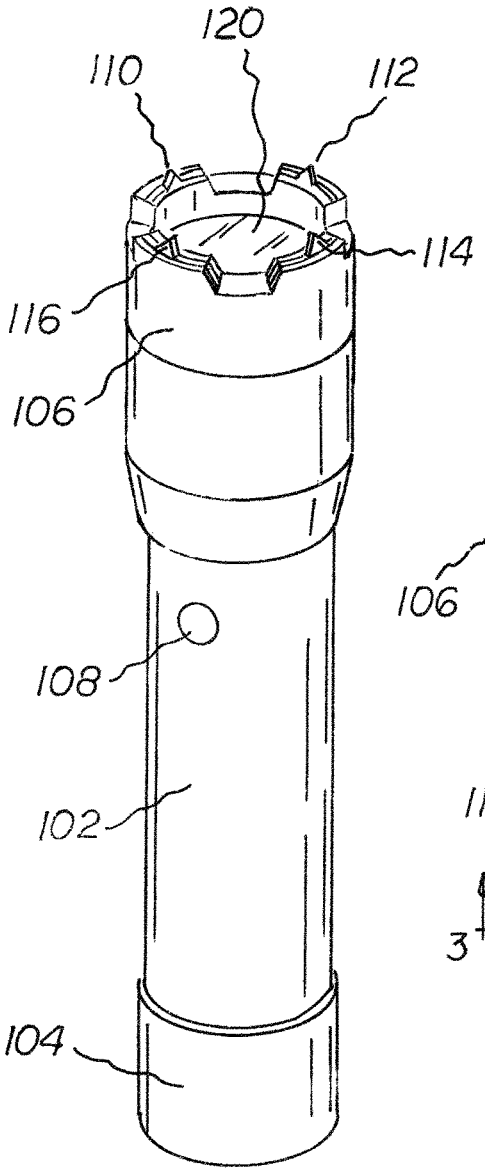
FIG. 1 is a front perspective view of a flashlight stun gun in a particular illustrative embodiment of the invention.

Referring initially to FIG. 1, a flashlight stun gun is shown and generally designated as 100. The flashlight stun 100 includes a cylindrical housing 102 having a top end and a bottom end 104. The bottom end 104 may be removable for accessing the interior of the cylindrical housing 102 and the power source (e.g., battery) stored inside.

The cylindrical housing is hollow and carries various electrical components. A collar 106 is secured to the top end of the cylindrical housing 102 and around a light emitting source 120, which may include a lens. The collar 106 has sidewalls extending away and upwards from the top end of the cylindrical housing 102 and the light emitting source 120 to define a top edge of the collar 106. The flashlight stun gun 100 combines components of an ordinary flashlight into a personal defense device as a stun gun. This can help in surprising an assailant and allowing a potential victim to escape injury. The cylindrical housing 102 may comprise a metal material, and the collar 106 may comprise a plastic or other suitable material having dielectric properties so that it does not interfere with the operation of the discharge circuitry described below.

First 110 and second electrodes 112 are embedded in a first portion of the top edge of the collar 106 and have a gap between to generate an electric arc across. Similarly, a third electrode 114 and a fourth electrode 116 are embedded in a second portion of the top edge of the collar 106. There is also a gap between the third electrode 114 and the fourth electrode 116 configured to generate an electric arc across. Each of the electrodes 110, 112, 114, 116 are comprised of a plate of conducting metal.

The first electrode 110 is coupled to a first lead of discharge circuitry, where the discharge circuitry is within the cylindrical housing 102. The second electrode 112 is coupled to the third electrode 114, and the fourth electrode 116 is coupled to a second lead of the discharge circuitry. The discharge circuitry may include a transformer coupled to a capacitor A trigger 108 is mounted to a side of the cylindrical housing 102, and is coupled to the discharge circuitry. The trigger 108, when depressed or otherwise activated, causes electric arcs across both the first and second gaps substantially contemporaneously. In particular, the first, second, third, and fourth electrodes 110, 112, 114, 116 are electrically coupled together in series when the discharge circuitry is activated. There may also be a power switch to turn the discharge circuitry on and off so that it cannot be accidentally activated by the trigger 108.

In an illustrative embodiment, the second and third electrodes 112, 114 are coupled together by a wire and there is no electric arc generated between them when the discharge circuitry is activated. In another embodiment, the second and third electrodes 112, 114 are contiguous and function as one physical electrode.

The first, second, third and fourth electrodes 110, 112, 114, 116 each comprise a portion that extends above the top edge of the collar 106. The top edge of the collar 106 comprises a notch at each of the first and second gaps and allows the electric arcs to be generated between the first and second electrodes 110, 112, and between the third and fourth electrodes 114, 116.

Figure 2:
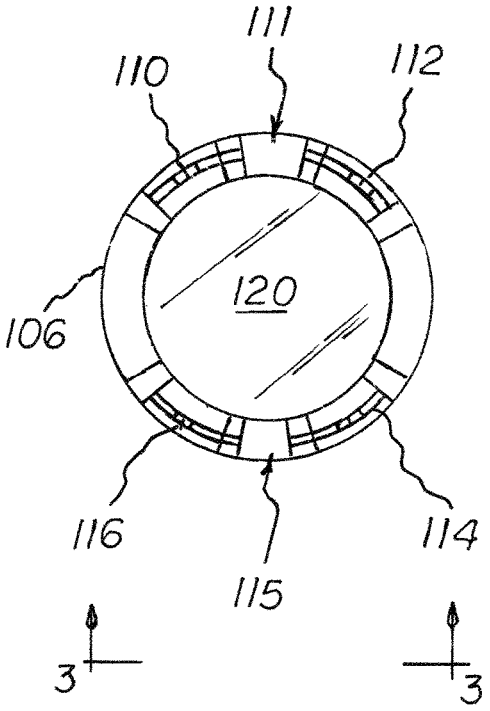
FIG. 2 is a top view of the flashlight stun gun.

Referring now to FIG. 2, the orientation of the electrodes 110, 112, 114, 116 is shown. In particular the first gap 111 and the second gap 115 are shown where the electric arcs are produced between first and second electrodes 110, 112, and the third and fourth electrodes 114, 116, respectively. As discussed above, there is no arcing between the second and third electrodes 112, 114, or between the first and the fourth electrodes 110, 116. The electric arcing in the first gap 111 and the second gap 115 is substantially contemporaneously to the naked eye because the electrodes 110, 112, 114, 116 are electrically coupled in series when the discharge circuitry is activated.

Figure 3:
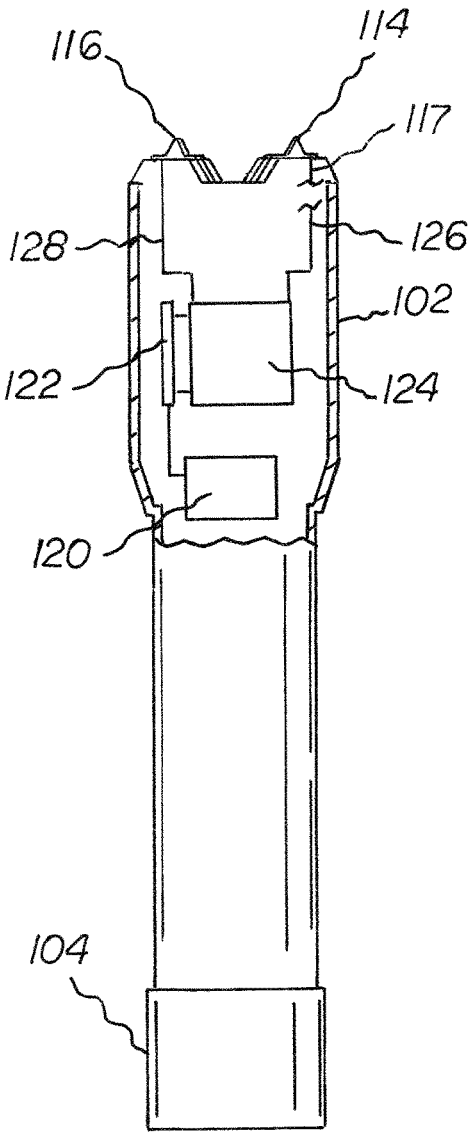
FIG. 3 is a partial elevational view of the flashlight stun gun.

As can be seen in FIG. 3, a schematic of the circuitry within the cylindrical housing 102 is shown through a partial view. A power source 120 is stored within the cylindrical housing 102. The power source 120 is typically a battery that may be rechargeable. The power source 120 is coupled to a control circuit 122 that may be coupled to the discharge circuitry 124, for example.

The discharge circuitry 124 has a first lead 126 coupled to the first electrode 110, and a second lead 128 coupled to the fourth electrode 116. The leads 126, 128 are preferably high voltage leads. A number of different electronic circuits and components may be used to provide the step-up voltage for the electrodes. For example, solid state oscillator circuitry may be used to produce the variable voltage that is required to drive the step-up transformer to generate the desired voltage. However, any conventional discharge circuitry may be incorporated herein.

Figure 4:
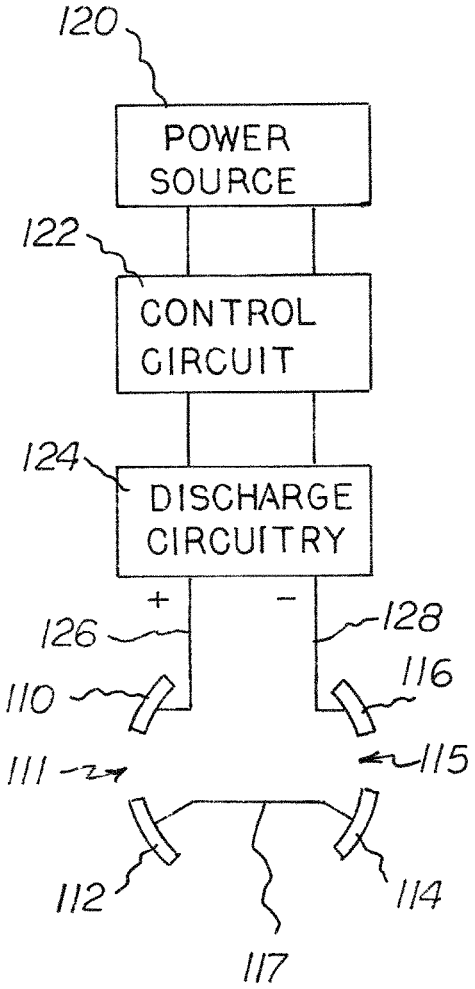
FIG. 4 is a schematic of circuitry of the flashlight stun gun.

Referring now to FIG. 4, a schematic of the circuitry of the flashlight stun gun 100 is shown. In particular, the orientation of the electrodes 110, 112, 114, 116 indicates that when the discharge circuitry 124 is activated, that the electrodes are coupled in series. For example, the first electrode 110 and the second electrode 112 are connected across the first gap 111 by electrical arcing. The second electrode 112 is directly coupled to the third electrode by a wire 117, for example. The third electrode 114 and the fourth electrode 116 are connected across the second gap 115 by electrical arcing similar to the first and second electrodes 110, 112 to complete the circuit. Accordingly, the electrical arcing at the first gap 111 and the second gap 115 appears to be substantially simultaneous. This allows the administration of a simultaneous high voltage shock to the assailant at points all around the perimeter of the collar 106.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A flashlight stun gun device comprising:

a cylindrical housing having a top end and a bottom end;

a power source within the cylindrical housing;

discharge circuitry within the housing and coupled to the power source, the discharge circuitry having a first lead and a second lead;

a light emitting source secured to the top end of the cylindrical housing and coupled to the power source;

a collar secured to the top end and around the light emitting source and having sidewalls extending away from the top end of the cylindrical housing and light emitting source to define a top edge of the collar;

first and second electrodes embedded in a first portion of the top edge of the collar and having a first gap therebetween to generate an electric arc across; and third and fourth electrodes embedded in a second portion of the top edge of the collar opposing the first pair of electrodes and having a second gap therebetween to generate an electric arc across;

wherein the first electrode is coupled to the first lead of the discharge circuitry, the second electrode and the third electrode are coupled together by a wire, and the fourth electrode is coupled to the second lead and is insulated from the first electrode.

2. The flashlight stun gun device of claim 1, further comprising a trigger coupled the discharge circuitry and operable by a user to cause the electric arcs across the first and second gaps.

3. The flashlight stun gun device of claim 1, wherein the first, second, third, and fourth electrodes are electrically coupled together in series when the discharge circuitry is activated.

4. The flashlight stun gun device of claim 1, wherein the second and third electrodes are combined as one physical electrode.

5. The flashlight stun gun device of claim 1, wherein the first, second, third, and fourth electrodes each comprise a portion that extends above the top edge of the collar.

6. The flashlight stun gun device of claim 1, wherein the top edge of the collar comprises a notch at each of the first and second gaps.

7. The flashlight stun gun device of claim 1, wherein the first, second, third, and fourth electrodes are each comprised of a plate of conducting metal.

8. The flashlight stun gun device of claim 1, wherein the discharge circuitry comprises a transformer and a capacitor coupled to the transformer.

9. A flashlight stun gun device comprising:

a cylindrical housing having a top end and a bottom end;

discharge circuitry within the housing, the discharge circuitry having a first lead and a second lead;

a light emitting source secured to the top end of the cylindrical housing;

a collar secured to the top end and around the light emitting source to define a top edge of the collar;

first and second electrodes embedded in a first portion of the top edge of the collar and having a first gap therebetween to generate an electric arc across; and third and fourth electrodes embedded in a second portion of the top edge of the collar opposing the first pair of electrodes and having a second gap therebetween to generate an electric arc across;

wherein the second and third electrodes are coupled together by a wire.

10. The flashlight stun gun device of claim 9, wherein the first electrode is coupled to the first lead of the discharge circuitry, the second electrode is coupled directly to the third electrode, and the fourth electrode is coupled to the second lead and is insulated from the first electrode.

11. The flashlight stun gun device of claim 9, further comprising a power source within the cylindrical housing.

12. The flashlight stun gun of claim 9, wherein the collar comprises sidewalls extending up from the top end of the cylindrical housing and light emitting source.

13. The flashlight stun gun device of claim 9, further comprising a trigger coupled the discharge circuitry and operable by a user to cause the electric arcs across the first and second gaps.

14. The flashlight stun gun device of claim 9, wherein the first, second, third, and fourth electrodes are electrically coupled together in series when the discharge circuitry is activated.

15. The flashlight stun gun device of claim 9, wherein the first, second, third, and fourth electrodes each comprise a portion that extends above the top edge of the collar.

16. The flashlight stun gun device of claim 9, wherein the top edge of the collar comprises a notch at each of the first and second gaps.

17. The flashlight stun gun device of claim 9, wherein the first, second, third, and fourth electrodes are each comprised of a plate of conducting metal.

18. A flashlight stun gun device comprising:

a housing having a top end and a bottom end;

discharge circuitry within the housing, the discharge circuitry having a first lead and a second lead;

a light emitting source secured to the top end of the housing;

first and second electrodes embedded in a first portion of a top edge of the housing and having a first gap therebetween to generate an electric arc across; and third and fourth electrodes embedded in a second portion of the top edge of the housing opposing the first pair of electrodes and having a second gap therebetween to generate an electric arc across;

wherein the electrodes are electrically coupled together in series when the discharge circuitry is activated and the second and third electrodes are coupled together by a wire.

* * * * *